US011376753B2

(12) United States Patent
Sullivan

(10) Patent No.: US 11,376,753 B2
(45) Date of Patent: Jul. 5, 2022

(54) DISPOSABLE UTILITY KNIFE WITH SAFETY LOCK

(71) Applicant: Edge Technologies Engineering, LLC, Travelers Rest, SC (US)

(72) Inventor: Scott Sullivan, San Francisco, CA (US)

(73) Assignee: Edge Technologies Engineering LLC, Travelers Rest, SC (US)

( * ) Notice: Subject to any disclaimer, the term of this patent is extended or adjusted under 35 U.S.C. 154(b) by 0 days.

(21) Appl. No.: 16/515,693

(22) Filed: Jul. 18, 2019

(65) Prior Publication Data

US 2020/0156269 A1 May 21, 2020

Related U.S. Application Data

(60) Provisional application No. 62/699,741, filed on Jul. 18, 2018.

(51) Int. Cl.
*B26B 5/00* (2006.01)
*B26B 1/08* (2006.01)

(52) U.S. Cl.
CPC ..... *B26B 5/001* (2013.01); *B26B 1/08* (2013.01)

(58) Field of Classification Search
CPC ..... B26B 5/001; B26B 5/003; B26B 5/005; B26B 5/006; B26B 1/08; B26B 1/10
USPC ..... 30/162; D8/99
See application file for complete search history.

(56) References Cited

U.S. PATENT DOCUMENTS 373,580 A * 11/1887 Boynton ..... B26B 5/001 30/162
2,569,080 A 9/1951 Trimble
2,862,296 A * 12/1958 Anderson ..... B26B 5/001 30/162
2,870,537 A * 1/1959 Ortner ..... B26B 5/001 30/162
3,448,518 A * 6/1969 Sklar ..... B26B 5/002 30/162
3,478,427 A * 11/1969 Tims, Jr. ..... B26B 5/005 D8/98
3,660,896 A 5/1972 Umholtz
D310,474 S * 9/1990 Bartsch ..... D8/99
5,093,994 A * 3/1992 Karas ..... B26B 5/001 30/162
5,230,152 A * 7/1993 Kennedy ..... B26B 5/001 30/162
5,277,888 A 11/1994 Baron et al.
(Continued)

FOREIGN PATENT DOCUMENTS

CN 102189558 A * 9/2011 ..... B26B 1/08

*Primary Examiner* — Jason Daniel Prone
(74) *Attorney, Agent, or Firm* — Thrive IP; Bernard S. Klosowski, Jr.

(57) ABSTRACT

A utility knife includes a hollow handle having a slot and an opening at each end. A razor is slidable between each end of the handle and may protrude at each opposing end for cutting use. The razor is mounted to a shuttle which includes a tab that is positioned within the slot. The user may use the tab to slide the shuttle and the blade within the handle between the two ends, as desired. A U-shaped blocking component is pivotally attached to the handle and is used to block sliding movement of the tab beyond a midpoint of the handle to prevent the razor protruding into the user's hand. The user must unlock the blocking element to safely allow the shuttle to be slid past.

19 Claims, 10 Drawing Sheets

(56) References Cited

U.S. PATENT DOCUMENTS

D355,345 S * 2/1995 Drust ..... D8/99
5,490,331 A * 2/1996 Gold ..... B26B 5/001 30/162
5,545,175 A 8/1996 Abidin
5,569,282 A 10/1996 Werner
5,779,724 A 7/1998 Werner
5,806,189 A * 9/1998 Bailey ..... B26B 5/001 30/162
5,906,049 A * 5/1999 Butts ..... B26B 5/001 30/125
5,909,930 A * 6/1999 Ragland, III ..... B26B 5/001 30/335
5,960,544 A * 10/1999 Beyers ..... B26B 5/001 30/162
6,006,433 A * 12/1999 Baltazar ..... B26B 5/001 30/162
6,148,522 A * 11/2000 Dobandi ..... B26B 5/001 30/162
D435,418 S * 12/2000 Beyers ..... D8/99
6,349,473 B1 2/2002 Schmidt
6,637,112 B2 10/2003 Davis
6,848,185 B2 2/2005 Tebo
6,957,491 B2 10/2005 Van Deursen et al.
7,101,382 B2 9/2006 George et al.
7,185,435 B1 3/2007 Tseng
7,340,836 B2 * 3/2008 Whitemiller ..... B26B 5/001 30/162
D580,241 S * 11/2008 Fraga ..... D8/20
7,533,467 B2 5/2009 Fossella
7,603,779 B2 * 10/2009 Rowlay ..... B26B 5/001 30/162
8,006,388 B1 * 8/2011 DeJesus ..... B26B 5/001 30/152
8,220,161 B2 * 7/2012 Chang ..... B26B 5/001 30/162
8,689,450 B2 * 4/2014 Constantine ..... B26B 1/08 30/162
8,701,293 B2 * 4/2014 Sullivan ..... B26B 1/10 30/162
9,656,397 B2 * 5/2017 Huhtala ..... B26B 1/08
9,925,674 B2 * 3/2018 Scimone ..... B26B 5/003
10,834,984 B2 * 11/2020 Farnum ..... B26B 1/08
2003/0079347 A1 5/2003 Davis
2004/0139614 A1 7/2004 Tebo
2005/0144787 A1 7/2005 Macri
2009/0094840 A1 4/2009 Kanemoto et al.
2009/0178283 A1 7/2009 Wu
2009/0223062 A1 9/2009 Tucker
2009/0235533 A1 9/2009 Huang
2010/0223793 A1 * 9/2010 Hansen ..... B26B 5/001 30/162
2010/0281696 A1 11/2010 Hao et al.
2014/0373363 A1 * 12/2014 Billado, Jr. ..... B26B 1/08 30/152
2019/0210233 A1 * 7/2019 Wang ..... B26B 5/003
2020/0122346 A1 * 4/2020 Vreeland ..... B26B 5/003
2022/0072721 A1 * 3/2022 Ng ..... B26B 5/001

* cited by examiner

Figure 1
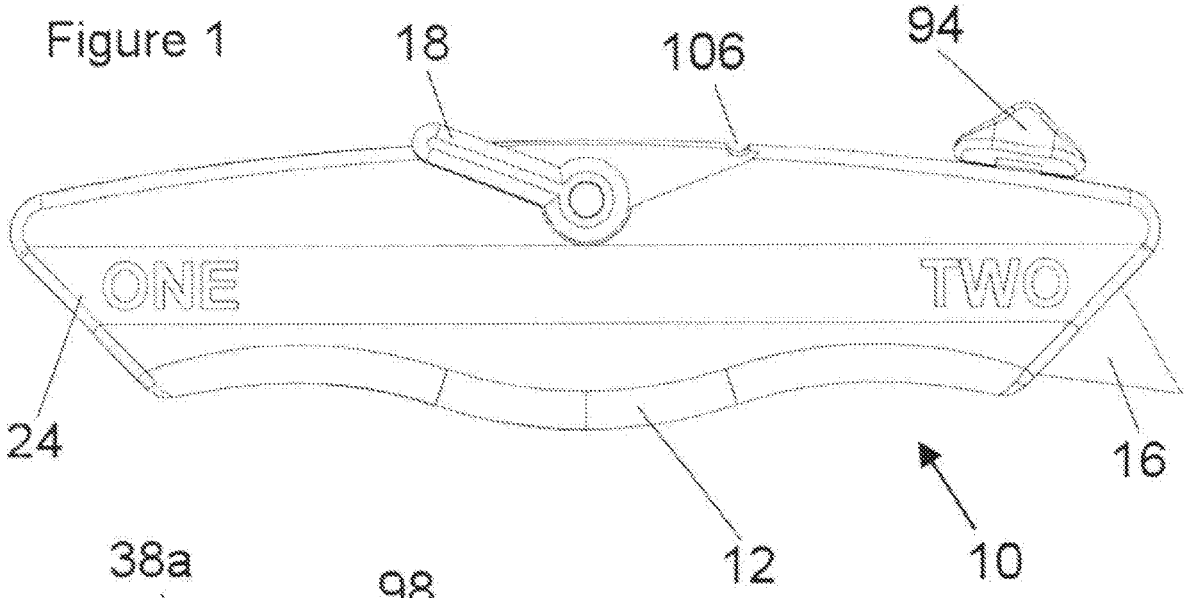
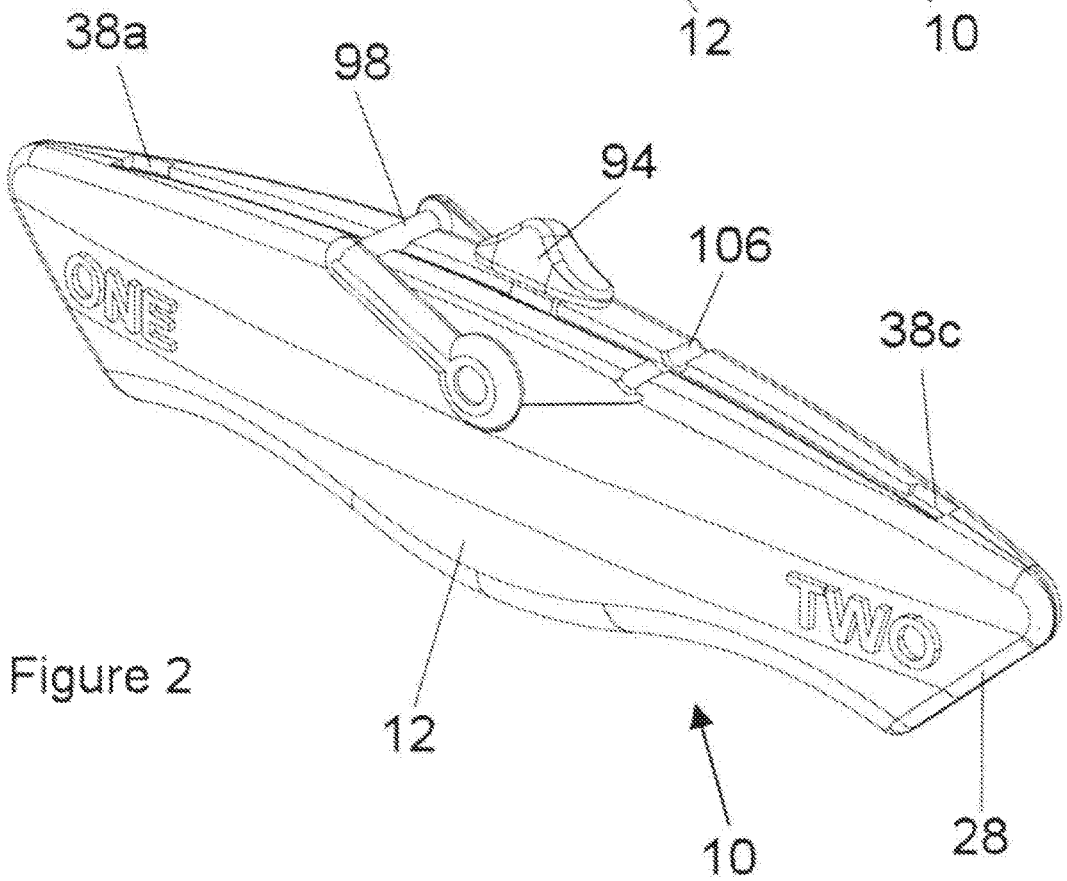
Figure 2

DISPOSABLE UTILITY KNIFE WITH SAFETY LOCK

RELATED APPLICATIONS

This application claims priority the benefit of U.S. Provisional Patent Application, No. 62/699,741, filed Jul. 18, 2018, entitled: "Low-Cost Disposable Utility Knife with Safety Lock," the contents of which are incorporated herein in their entirety.

FIELD OF THE INVENTION

The present invention relates to knives of the type commonly used to open and cutup corrugated boxes, cut sheetrock and other materials, and more particularly, to such knives that are disposable (i.e., of the type which provides no access to replace blades).

BACKGROUND OF THE INVENTION

So-called utility knives have been around for several decades. There have been numerous designs over the years, but regardless, all utility knives are generally simple in construction, providing a handle, a blade holder, and a selectively retractable razor blade.

The blade used in most utility knives has been standardized. It is generally made from sheet steel and is trapezoidal in planar shape. The long edge of the trapezoid-shaped blade is sharpened and defines the cutting edge of the blade. The short edge, opposite the cutting edge, (or top edge) of the blade includes two symmetrical U-shaped notches, directed towards the cutting edge. The two sides are symmetrically angled to connect the short edge with the long cutting edge, as is well known by those of ordinary skill in the art.

The blade fits snugly within the blade holder and the blade holder fits slidably within the handle. A conventional utility knife handle is usually made up of two hollow halves that may be selectively locked to each other to form a study handle and define a combined hollow cavity in which the blade holder and blade may reside and operate (as well as provide storage for additional blades). The combined handle assembly further includes a slot through which a portion of the blade holder may pass, in the form of a tab (finger purchase). The tab provides operational access to the user so that the user may selectively slide the blade holder, and therefore the blade as desired within a restricted range of displacement, while holding the handle. The blade holder (and blade) may be selectively displaced between a fully retracted position and an extended position. The blade in the fully retracted position is safely positioned within the housing. In contrast, the blade in the extended position exposes a portion of its cutting edge beyond one end of the handle so that useful cutting work may be performed by the user.

The blades of many such conventional utility knives can be replaced when they become dull, either by separating the two handle-halves or by feeding a new blade directly into the blade holder from the front of the knife. Although providing a feature of allowing replacement of a dull blade is generally beneficial, there has been a growing demand to provide a simple, safe and easy to use disposable utility knife that can be used and then just thrown away when the blade becomes dull. In response to this demand, several disposable utility knives are commercially available today. Some of these disposable utility knives include automatically activated safety covers or shields which move to cover and protect the otherwise exposed sharpened edge when the blade is not being used to cut, yet remains on "standby" with the blade protruding from the handle.

A problem with conventional disposable type utility knives is that they are still relatively expensive, considering that they only provide a single blade and when that blade dulls, the knife must be disposed. These knives also typically only offer a short cutting edge, between ¼" and ⅜". There have been complaints that the short cutting edge is not sufficient to fully cut thick corrugated shipping boxes and the shorter blade often dulls more quickly since a concentrated section of the blade is relied upon to perform all the cutting.

Accordingly, there remains room for improvement and variation within the art.

SUMMARY OF THE INVENTION

It is one aspect of at least one of the present embodiments to provide a useful, low cost disposable utility knife that is made up of few parts.

It is another aspect of at least one of the present embodiments to provide a disposable utility knife that is easy to manufacture and assemble.

It is another aspect of at least one of the present embodiments to provide a useful, low cost disposable utility knife that provides extended use for cutting.

It is yet another aspect of at least one of the present embodiments to provide a utility knife that is easy to use and that uses both sides of the conventional utility blade without opening the handle assembly.

It is yet another aspect of at least one of the present embodiments to provide a utility knife that is easy to use and that uses both sides of the conventional utility blade without opening the handle assembly, and provides an intuitive safety lock.

It is yet another aspect of at least one of the present embodiments to provide a portable utility knife comprising: a hollow elongated handle sized and shaped to be easily gripped by a user's hand, the handle including an upper surface and opposing first and second ends, the hollow handle defining a cavity therein; an elongated slot disposed along the upper surface, the slot providing access through the handle to the cavity; a first opening located at the first end and a second opening located at the second end, the first and second openings extending through the handle to the cavity; a blade shuttle positioned within the cavity and selectively slidable between the first end and the second end; a razor blade secured to the shuttle, the razor blade having a cutting edge, the cutting edge defining a first cutting edge section and a second cutting edge section so that when the shuttle is positioned within the cavity and adjacent the first end, the first cutting edge section of the razor blade extends through the first opening of the handle to expose the first cutting edge section to provide useful cutting work, and when the shuttle is positioned adjacent the second end, the second cutting edge section of the razor blade extends through the second opening to expose the second cutting edge section to provide useful cutting work;

a tab attached to the blade shuttle, the tab extending through the elongated slot so that a portion of the tab is accessible to a user, the tab may be used to slide the shuttle within the cavity between the first and second ends; and a movable locking component attached to the handle, the locking component being selectively moveable between a first position, wherein the tab is prevented from sliding within the elongated slot, and a second position, wherein the tab is permitted to slid within the elongated slot.

It is yet another aspect of at least one of the present embodiments to provide a knife wherein the locking component is U-shaped and is pivotally attached to the handle.

It is yet another aspect of at least one of the present embodiments to provide a knife wherein the U-shaped locking component is pivotally attached to the handle across the elongated slot and is pivotal between a down position, wherein the tab is physically blocked from sliding along the elongated slot, and an up position, wherein the tab is permitted to slide along the elongated slot under the U-shaped locking component.

It is yet another aspect of at least one of the present embodiments to provide a knife wherein the elongated slot includes at least one locking notch into which the tab may selectively engage to lock the tab with respect to the handle.

It is yet another aspect of at least one of the present embodiments to provide a knife wherein the tab is spring-biased to automatically engage the at least one locking notch when the tab aligns with the locking notch during sliding displacement along the elongated slot.

It is yet another aspect of at least one of the present embodiments to provide a knife wherein the at least one locking notch is positioned at the midpoint of the elongated slot.

It is yet another aspect of at least one of the present embodiments to provide a knife wherein the locking component is located at the middle of the elongated slot.

It is yet another aspect of at least one of the present embodiments to provide safety knife for use by a user, the knife comprising: an elongated handle having opposing first and second ends; a blade assembly slidably attached to the handle, the blade assembly being selectively slidable between the first and second ends, the blade assembly including a cutting edge that is exposed for useful work by the user when the blade assembly is located adjacent one of the first and second ends; and an obstructive component moveably attached to the handle, the obstructive component being moveable between an obstructive position, wherein sliding passage of the blade assembly between the first and second ends of the handle is prevented and a non obstructive position, wherein sliding passage of the blade assembly between the first and second ends is permitted.

It is yet another aspect of at least one of the present embodiments to provide a knife wherein the elongated handle is hollow and the blade assembly is slidably disposed within the hollow handle.

It is yet another aspect of at least one of the present embodiments to provide a knife wherein the blade assembly further comprises a tab and wherein the hollow handle comprises an elongated slot through which the tab is positioned and along which the tab may slide.

It is yet another aspect of at least one of the present embodiments to provide a knife wherein the obstructive component is a U-shaped member that is pivotally attached to the handle.

It is yet another aspect of at least one of the present embodiments to provide a knife wherein the U-shaped obstructive component is pivotally attached to the handle across the elongated slot and is pivotal between a down position, wherein the tab is physically blocked from sliding along the elongated slot, and an up position, wherein the tab is permitted to slide along the elongated slot under the U-shaped locking component.

It is yet another aspect of at least one of the present embodiments to provide a knife wherein the elongated slot includes at least one locking notch into which the tab may selectively engage to lock the tab with respect to the handle.

It is yet another aspect of at least one of the present embodiments to provide a knife wherein the tab is spring-biased to automatically engage the at least one locking notch when the tab aligns with the locking notch during sliding displacement along the elongated slot.

It is yet another aspect of at least one of the present embodiments to provide a knife wherein the at least one locking notch is positioned at the midpoint of the elongated slot.

It is yet another aspect of at least one of the present embodiments to provide a knife wherein the obstructive component is located at the middle of the elongated slot.

It is yet another aspect of at least one of the present embodiments to provide a safety knife for use by a user, the knife comprising: an elongated handle having opposing first and second ends; a blade assembly slidably attached to the handle, the blade assembly being selectively slidable between the first and second ends, the blade assembly including a cutting edge that is exposed for useful work by the user when the blade assembly is located adjacent one of the first and second ends; an access tab attached to the blade assembly, the access tab being accessible to the user; and a U-shaped locking component pivotally attached to the handle between a blocking position, wherein the tab is physically blocked from sliding between the first and second ends, and a non-blocking position, wherein the tab is permitted to slide between the first and second ends; an obstructive component moveably attached to the handle, the obstructive component being moveable between an obstructive position, wherein sliding passage of the blade assembly between the first and second ends of the handle is prevented and a non obstructive position, wherein sliding passage of the blade assembly between the first and second ends is permitted.

It is yet another aspect of at least one of the present embodiments to provide a knife wherein the handle includes at least one locking notch into which the tab may selectively engage to lock the tab with respect to the handle.

It is yet another aspect of at least one of the present embodiments to provide a knife wherein the tab is spring-biased to automatically, engage the at least one locking notch when the tab aligns with the locking notch during sliding movement between the first and second ends.

It is yet another aspect of at least one of the present embodiments to provide a knife wherein the at least one locking notch is positioned generally at the midpoint between the first and second ends.

As described herein, a low cost disposable utility knife includes a hollow handle having an elongated slot and an opening at each end. A blade shuttle holds a trapezoidal razor blade and is slidably mounted on tracks integrally formed within the hollow handle and slidable between each end of the handle. When the shuttle is located at either end, a cutting edge of the razor extends beyond the opening of the adjacent handle end and is accessible for useful cutting work by a user. The shuttle includes a tab that is positioned within the elongated slot and includes a portion that is accessible to the user. The user may use the accessible tab to slide the shutter and the blade within the handle between the two ends, as desired. A U-Shaped flip lock is pivotally attached to the handle between a down position, wherein the tab is physically blocked from sliding along the elongated slot, and an up position, wherein the tab is permitted to slide along the elongated slot, passing under the U-shaped flip lock.

The elongated slot may further include at least one locking notch into which a portion of the tab may selectively engage. The tab may be spring-biased to automatically engage the at least one locking notch when the tab resides adjacent thereto.

The features of this invention, and the manner of attaining them, will become more apparent and the invention itself will be better understood by reference to the following description of the disclosed embodiments taken in conjunction with the accompanying drawings. Such features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

FIG. 1 is a side elevation view of a utility knife, according to the present invention, including a handle, a blade, a blade shuttle having an integral finger tab and a flip lock shown in a first down and locked position, the blade being shown in an extended position at a first end of the handle labeled "TWO".

FIG. 2 is a perspective view of the knife of FIG. 1, according to the present invention.

DESCRIPTION OF THE PREFERRED EMBODIMENT

Figure 3:
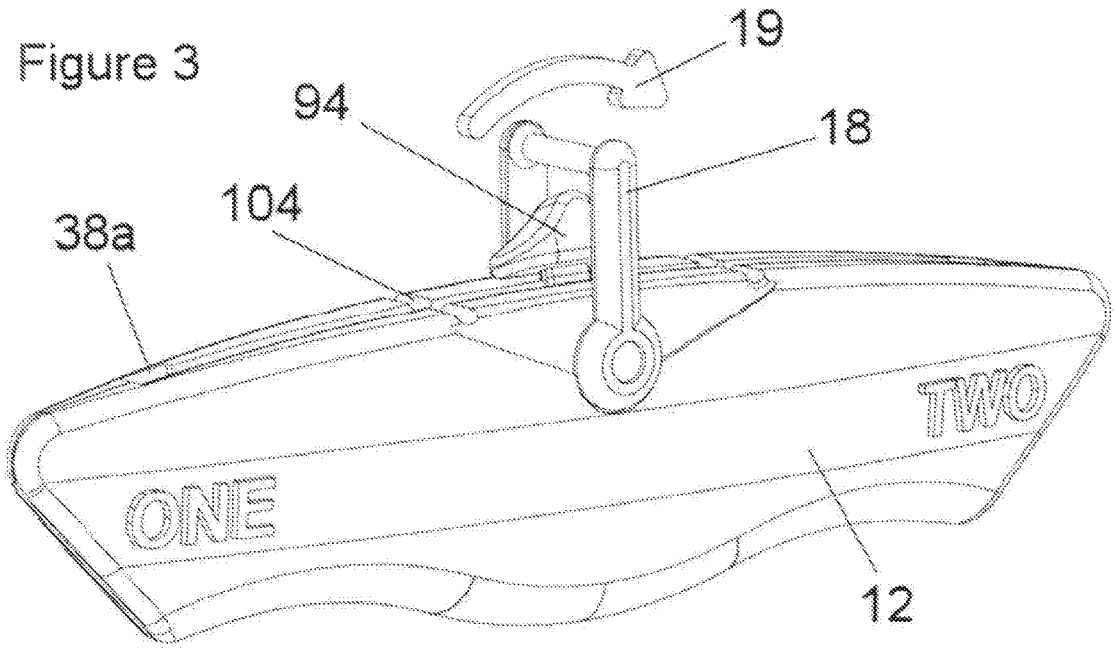
FIG. 3 is a perspective view of the knife of FIG. 1, showing the blade shuttle repositioned to a midpoint of the handle, and showing the flip lock being moved to a vertical unlocked position so that finger tab may pass from a first end of the handle, labeled "TWO," to an opposite end of the handle, labeled "ONE," according to the present invention.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

Referring to FIG. 1, a disposable utility knife 10, according to the invention is shown having a handle 12, made up of two halves 12*a* and 12*b*, a blade shuttle 14, supporting a metal razor blade 16, and a flip lock 18. The basic structure of knife 10 is that although it is meant to be disposable, it provides the user two separate blades, so this knife will last twice as long as similar knives that offer only a single blade. The basic structure of knife 10 is similar to the one disclosed in U.S. Pat. No. 8,701,293 of Scott Sullivan, entitled "Utility Knife," in that both designs include a handle and a slidable blade that can be selectively displaced from one end to the other to effectively provide two separate cutting edges. The entire content of U.S. Pat. No. 8,701,293 is hereby incorporated by this reference.

Referring to FIGS. 6, 8, 9 and 10, each handle half 12*a*, 12*b* is preferably made from an appropriate strong light-weight thermoplastic, such as ABS, and is made so that when the two halves are secured together, a cavity 20 is formed therebetween.

Handle half 12*a* includes an arcuate upper surface 22, defining an upper slot 23, a first end 24 having a first end recess 26, a second opposing end 28 having a second end recess 30. Recesses 26, 30 are sized and shaped to accommodate blade 16, as described in greater detail below. Handle half 12*a* further includes a pair of integrally formed arcuate shuttle guide rails 32*a* and 32*b*, and an integrally formed arcuate blade guide rail 34. Blade guide rail 34, shuttle guide rails 32*a*, 32*b* and upper surface 22 preferably have common radius of curvature and are therefore effectively parallel to each other. Handle half 12*a* further includes a lower grip-bulge 36, which provides a gripping point for a user holding the assembled knife 10. Along upper surface 22 are preferably at least three locking notches 38*a*, 38*b*, and 38*c*, which help lock blade shuttle 14 at prescribed positions about handle 12, as described below. Handle half 12*a* further includes upper protrusions 40*a*, 40*b* located adjacent first end 24 and second end 28, respectively, and lower central protrusion 42, which are sized and shaped to snugly receive similarly shaped recesses located on the opposing handle half 12*b*, as described below. Handle half 12*a* further includes a post 44 which projects outward from the handle half and is centrally located, near upper surface 22, as shown in FIG. 8.

Handle half 12*b* has many similar features to that of handle half 12*a*, including an arcuate upper surface 50, defining an upper slot 51, a first end 52 having a first end recess 54, a second opposing end 56 having a second end recess 58. Recesses 54, 58 are sized and shaped to accommodate blade 16, as described in greater detail below. Handle half 12*b* further includes a pair of integrally formed arcuate shuttle guide rails 60*a* and 60*b*. Handle half 12*b* does not require a blade guide rail, as does handle 12*a*. Shuttle guide rails 60*a*, 60*b* and upper surface 50 preferably have common radius of curvature and are therefore effectively parallel to each other. Handle half 12*b* further includes a lower grip-bulge 66, which provides a gripping point for a user holding the assembled knife 10. According to this invention, upper surface 50 does not require any locking notches. Handle half 12*b* further includes upper recesses 70*a*, 70*b*, adjacent first end 52 and second end 56, respectively, and lower central recess 72, which are sized and shaped to snugly receive similarly shaped protrusions 40*a*, 40*b* and 42 located on the opposing handle half 12*a*, introduced above. Handle half 12*b* further includes a post 74 which projects outward from the handle half and is centrally located, near upper surface 50, as shown in FIG. 8.

Figure 11:
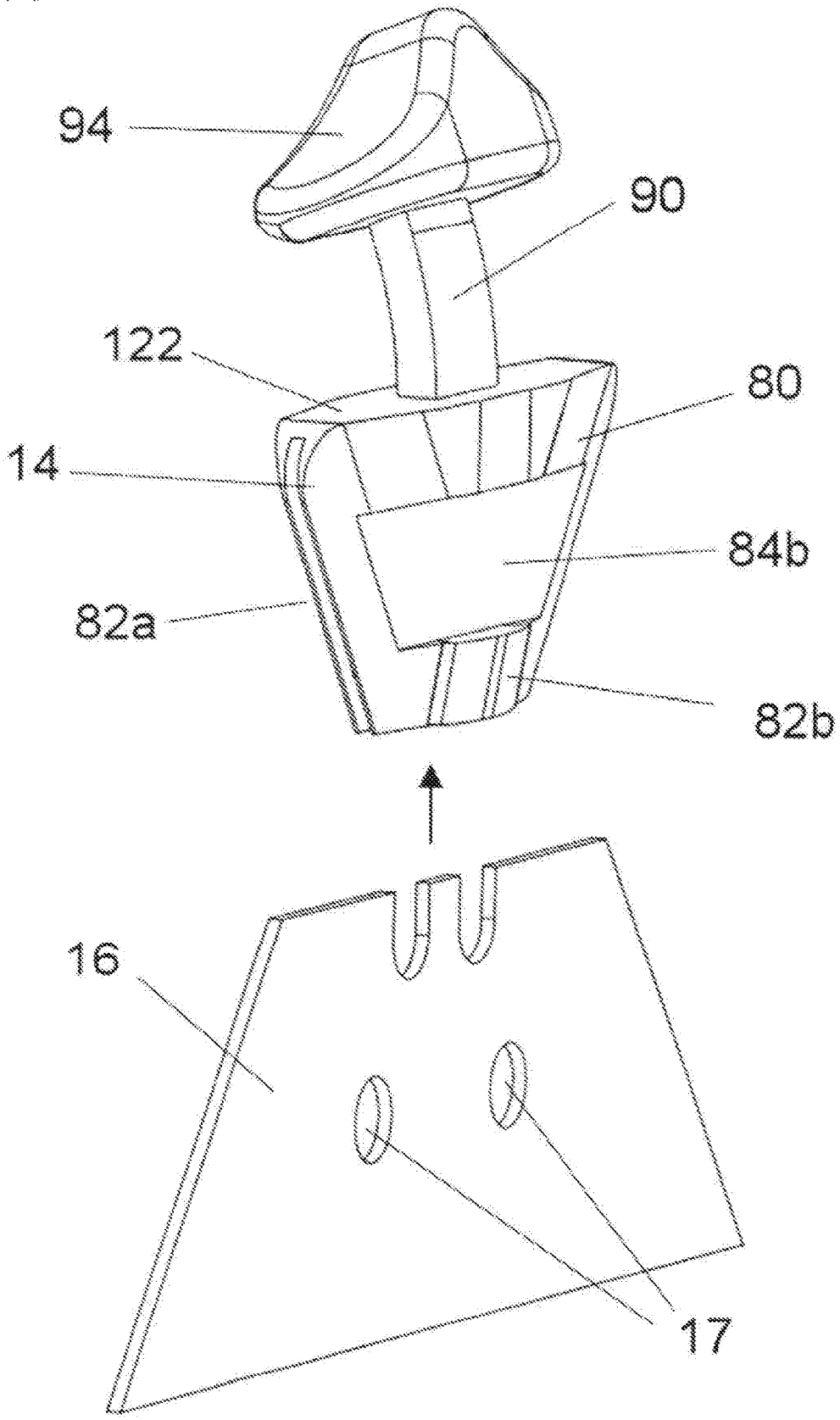
FIG. 11 is an assembly view of the shuttle and blade, according to the invention.

Referring now to FIGS. 6, 8, 9, 11, and 12, blade shuttle 14 is meant to securely hold razor blade 16 and move the blade within handle 12. Blade 16 can be glued to shuttle 14, but is preferably molded to shuttle 14 during the injection-molding of shuttle 14 using an insert molding process wherein blade 16 is inserted into the mold of shuttle 14 before plastic is injected into the mold. In the injection molding process, the molten plastic forms shuttle 14 around the inserted blade 16, to create a shuttle and blade assembly, which is shown in FIGS. 6, 8, 9 and 12. As shown in FIG. 11, blade 16 preferably includes bores 17 which aid in securing blade 16 to shuttle 14 during the molding process, as is well known by those of ordinary skill in the art.

Figure 8:
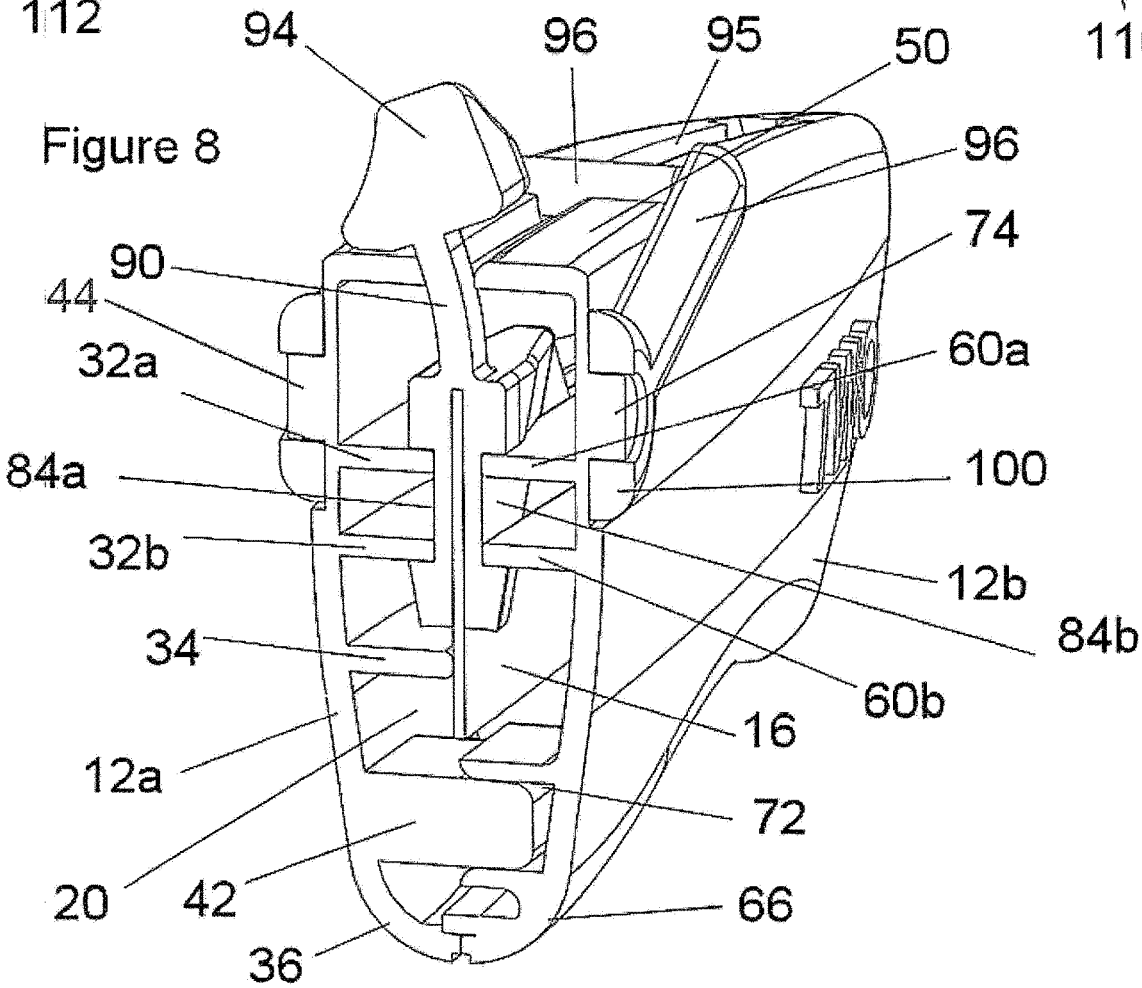
FIG. 8 is a sectional view of the knife of FIG. 4, taken along the line 8-8 of FIG. 4, showing details of the blade shuttle, guide rails, blade support rail, the flip lock, and the finger tab, according to the present invention.
Figure 12:
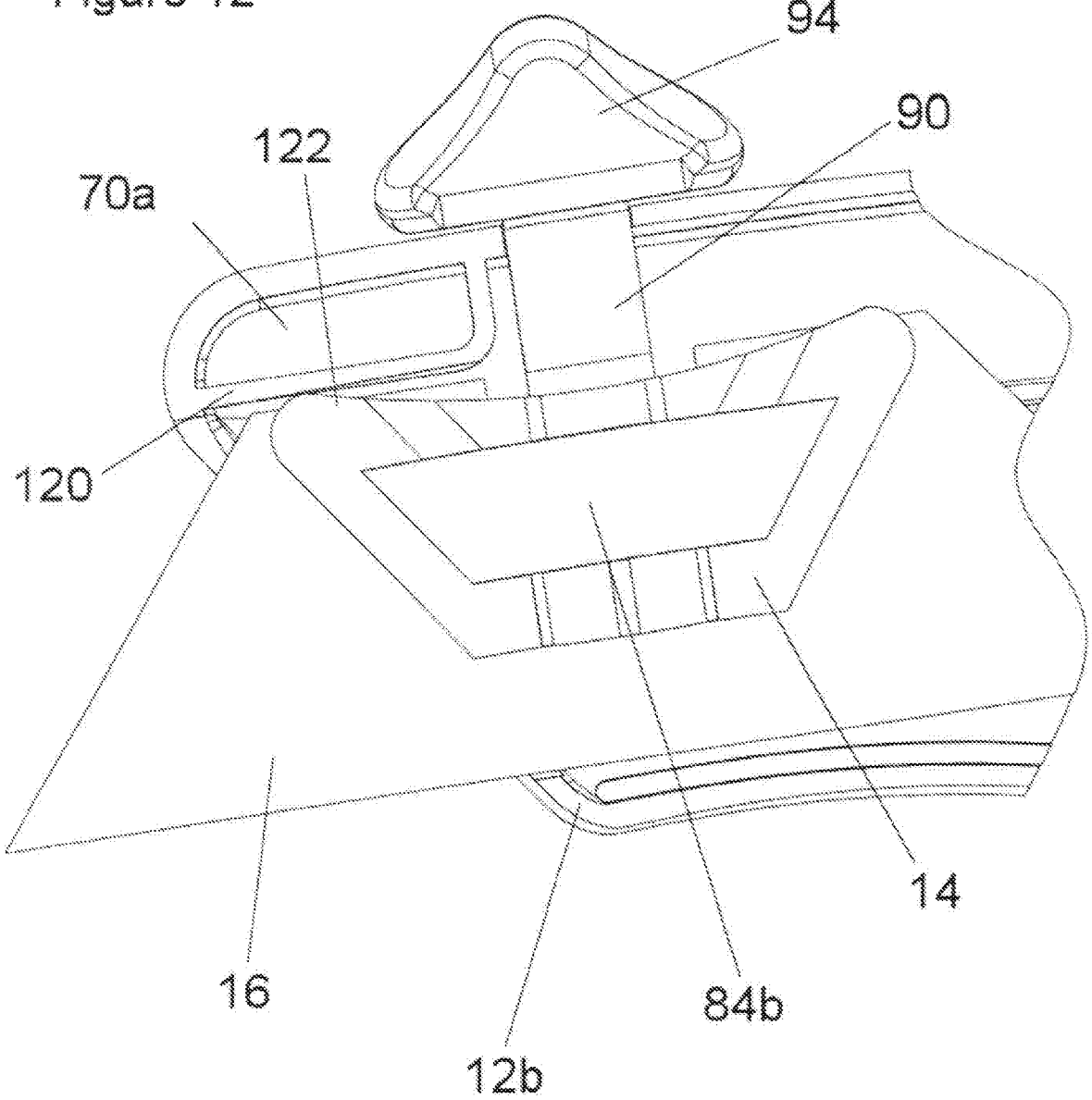
FIG. 12 is an enlarged partial side view of the shuttle, blade and handle halve, showing details of a blade-anti-rotation structure, according to the invention.

As shown in FIGS. 8, 11 and 12, shuttle 14 includes a flat trapezoidal-shaped body 80 which extends on both sides of blade 16, defining a left side 82*a*, and a right side 82*b*. Body 80 includes a left side guide channel 84*a* and a right side guide channel 84*b*. When knife 10 is fully assembled, left side guide channel 84*a* is sized and shaped to snugly and slidably engage guide rails 32*a*, 32*b* of handle half 12*a*, as shown in FIG. 8. Similarly, right side guide channel 84*b* of body 80 is sized and shaped to snugly and slidably engage guide rails 60*a*, 60*b* of handle half 12*b*. Since guide rails 32*a,b*, 60*a,b* follow a slight curve between opposing handle ends, guide channels 84*a*, 84*b* are also formed slightly curved to follow the respective guide rails. As shown in FIG. 11, a stem 90 extends from a top surface 122 of shuttle body 80. As shown in the figures, stem 90 is formed with a slight curve. A finger tab 94 is formed at the upper end of stem 90. As shown in FIG. 8, when knife 10 is assembled, slots 23 and 51 (of the two handle halves 12*a*, 12*b*) combine to form a slot 95 that is sized to fit curved stem 90. As curved stem 90 slides within slot 95, eventually stem 90 will align with one of the three locking notches, 38*a*, 38*b*, and 38*c*. When this happens, the spring-biased stem 90 forces itself into the aligned notch 38. The natural resiliency of the molded stem 90 provides sufficient spring bias to lock shuttle in place at any of the locations of locking notches 38*a*, 38*b*, and 38*c*. To release the engaged stem 90 from any notch 38, finger tab 94 must be pressed (by the user's finger) laterally against the spring-bias until stem 90 is moved out of engagement of any notch 38*a,b,c*. Only then can finger tab 94, stem 90, shuttle 14 and blade 16 be displaced along slot 95. The type of plastic used to make shuttle 14 is preferably strong and resilient, and if possible naturally lubricious. The plastic used to make shuttle 14 can be different from the plastic used to make handle halves 12*a*, 12*b*.

Figure 4:
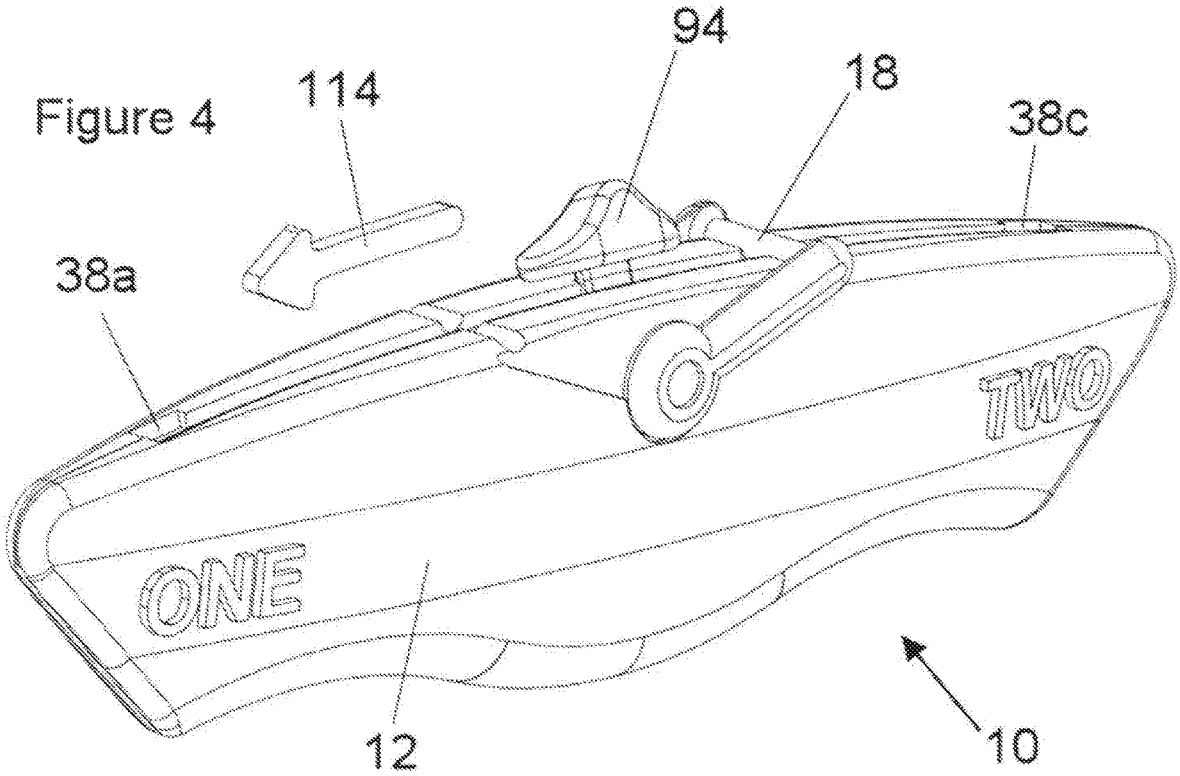
FIG. 4 is a perspective view of the knife of FIG. 3, showing the blade shuttle still at the midpoint of the handle, but showing the flip lock being moved to a second down and locked position, thereby preventing the blade shuttle from accidentally returning to the first end of the handle, labeled "TWO," allowing the finger tab, and the blade shuttle located within the handle, to only advance to the second end of the handle, labeled "ONE," indicated by the arrow, according to the present invention.
Figure 5:
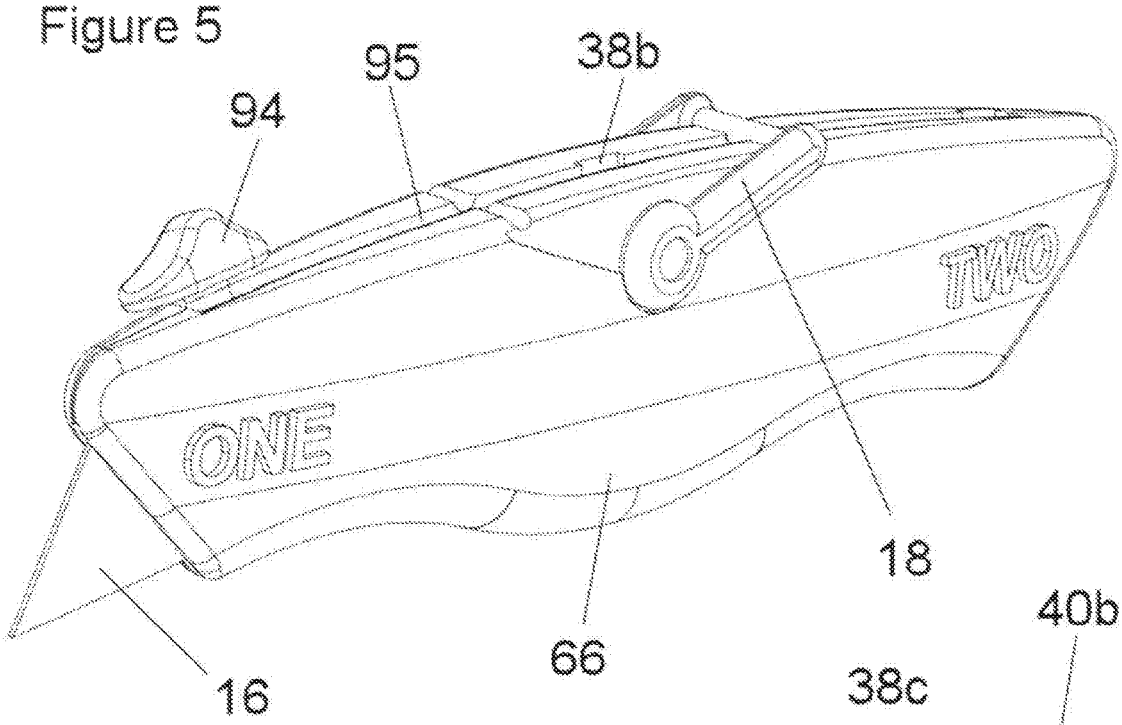
FIG. 5 is a perspective view of the knife of FIG. 4, showing the flip lock still in the second down and locked position, and showing the finger tab, and therefore the blade shuttle located at the second end of the handle, labeled "ONE," with the blade in an extended position, according to the present invention.
Figure 9:
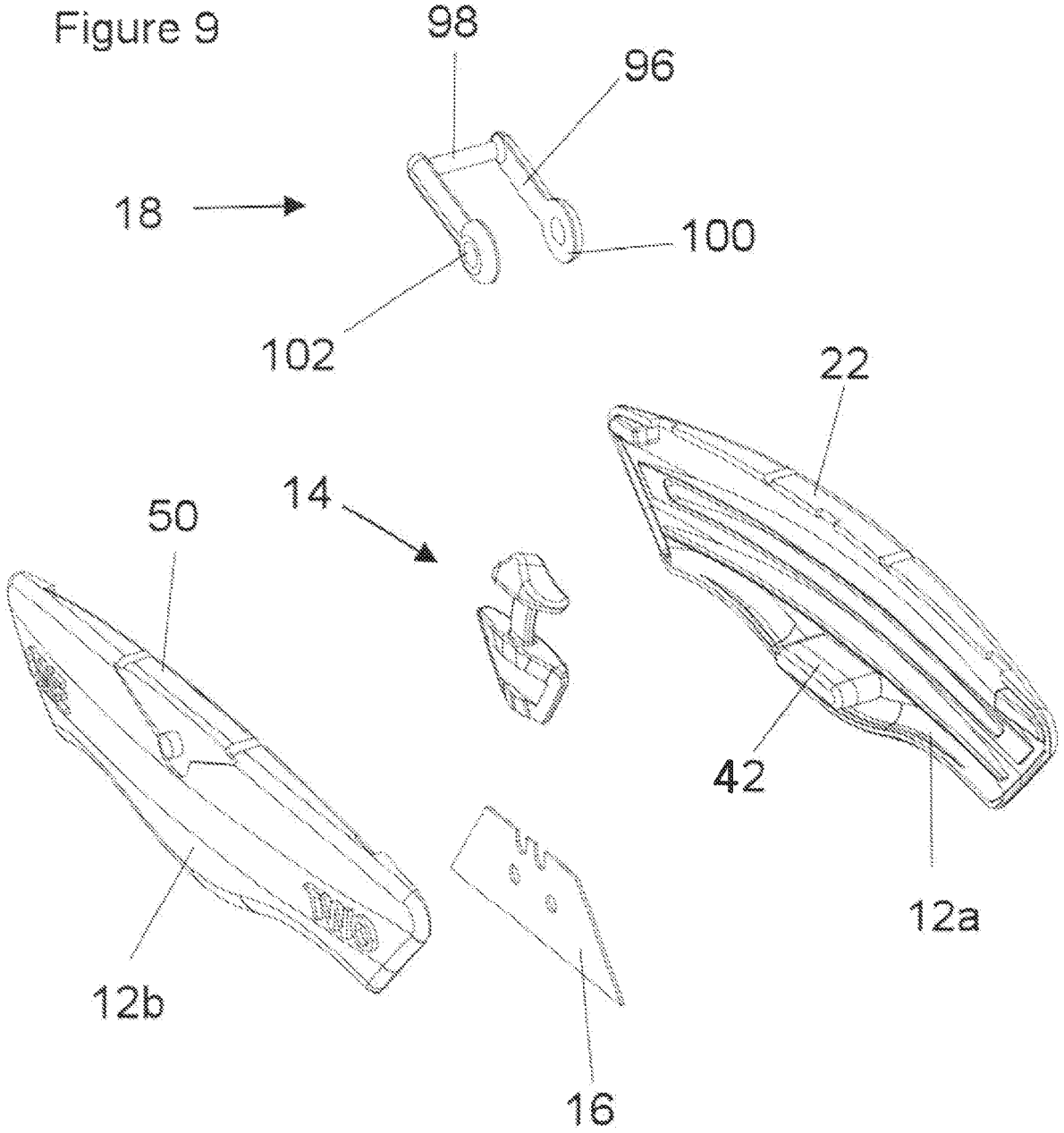
FIG. 9 is an exploded perspective view of the knife of FIG. 1, showing assembly details, according to the present invention.

As shown in FIGS. 2, 3, and 9, flip lock 18 is a U-shaped structure with two parallel side bars 96 connected at one end of each to a crossbar 98. A bearing boss 100 with a central bore 102 is formed at the open end of each side bar 96. Bore 102 of each bearing boss 100 is sized to snugly fit onto posts 44, 74, so that flip lock 18 becomes pivotally attached to the outside of each handle half 12*a*, 12*b* with crossbar 98 positioned across upper surfaces 22, 50 of handle halves 12*a*, 12*b*. Flip lock 18 is pivotal between a first locked position (closer to the handle end labeled "ONE"), shown in FIG. 1, a vertical unlocked position, shown in FIG. 3, and a second locked position (closer to the handle end labeled "TWO"), shown in FIG. 4. Each handle half 12*a*, 12*b* may further include a first lock channel 104 and a second lock channel 106, each of which is sized and shaped to receive a portion of crossbar 98, as shown in FIGS. 2, 4, and 5. Flip lock 18 is preferably made from a strong resilient plastic, such as ABS or PVC.

Figure 6:
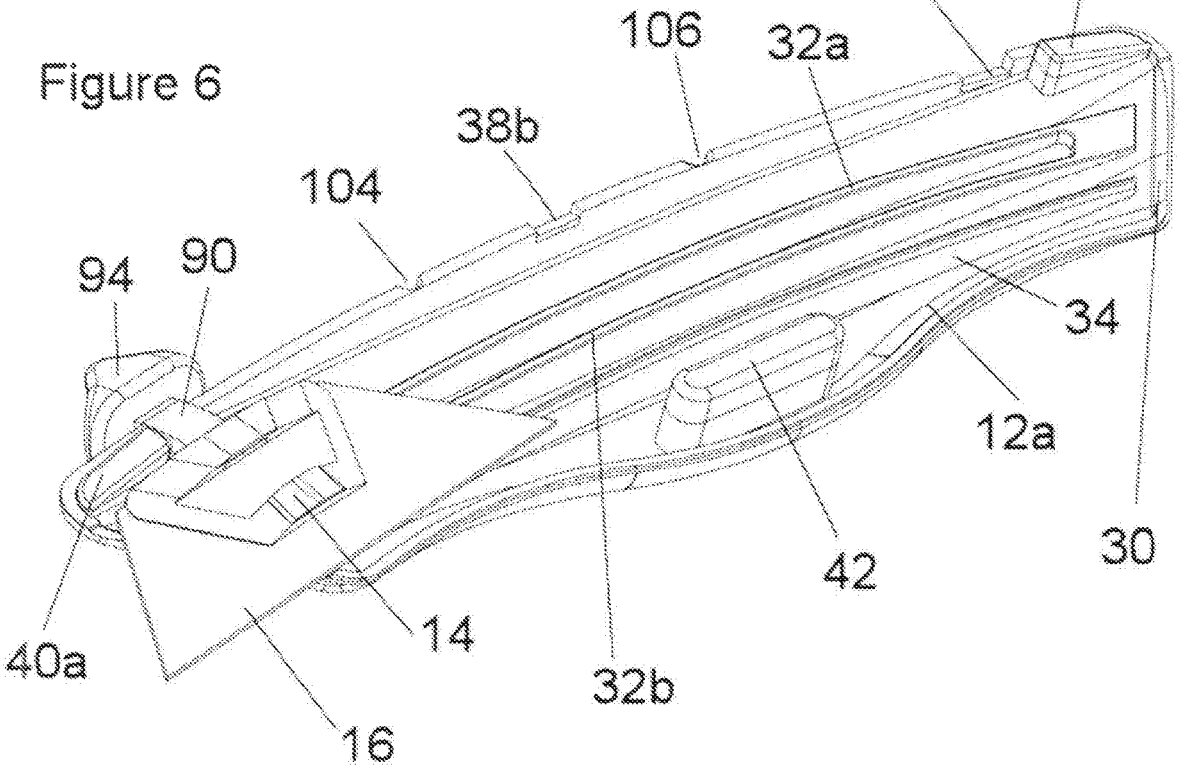
FIG. 6 is a perspective view of one handle half of the knife of FIG. 1, showing details of the blade shuttle, the finger tab, and a blade, according to the present invention.
Figure 7:
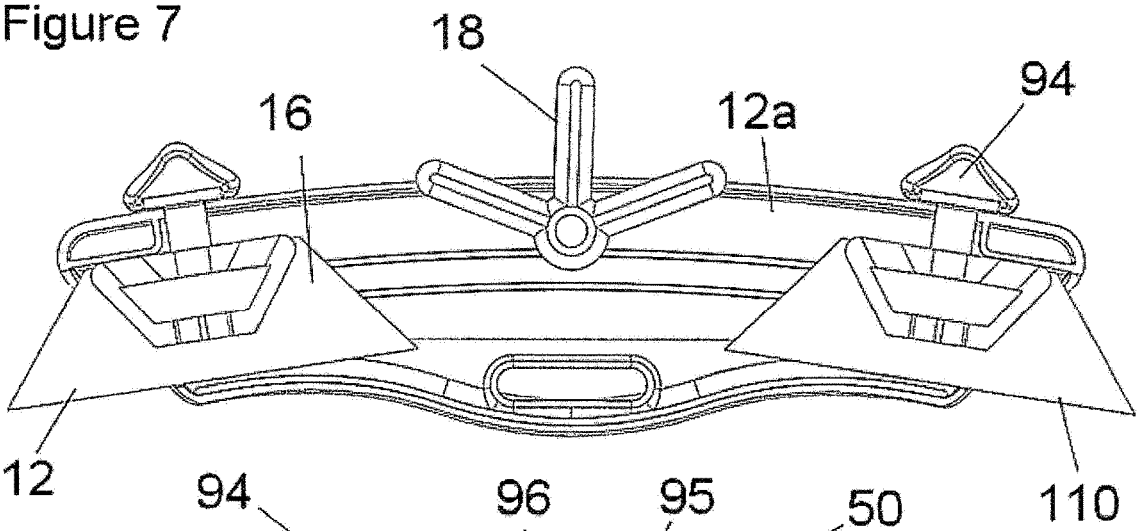
FIG. 7 is a plan side view of one handle half of the knife of FIG. 1, showing representative blade shuttles and blades and flip locks to illustrate the range of movement of the blade shuttle and blade, from one end of the handle to the other, and the range of movement of the flip lock, from a first locked position, to a unlocked vertical position, and back to a second locked position, according to the present invention.
Figure 10:
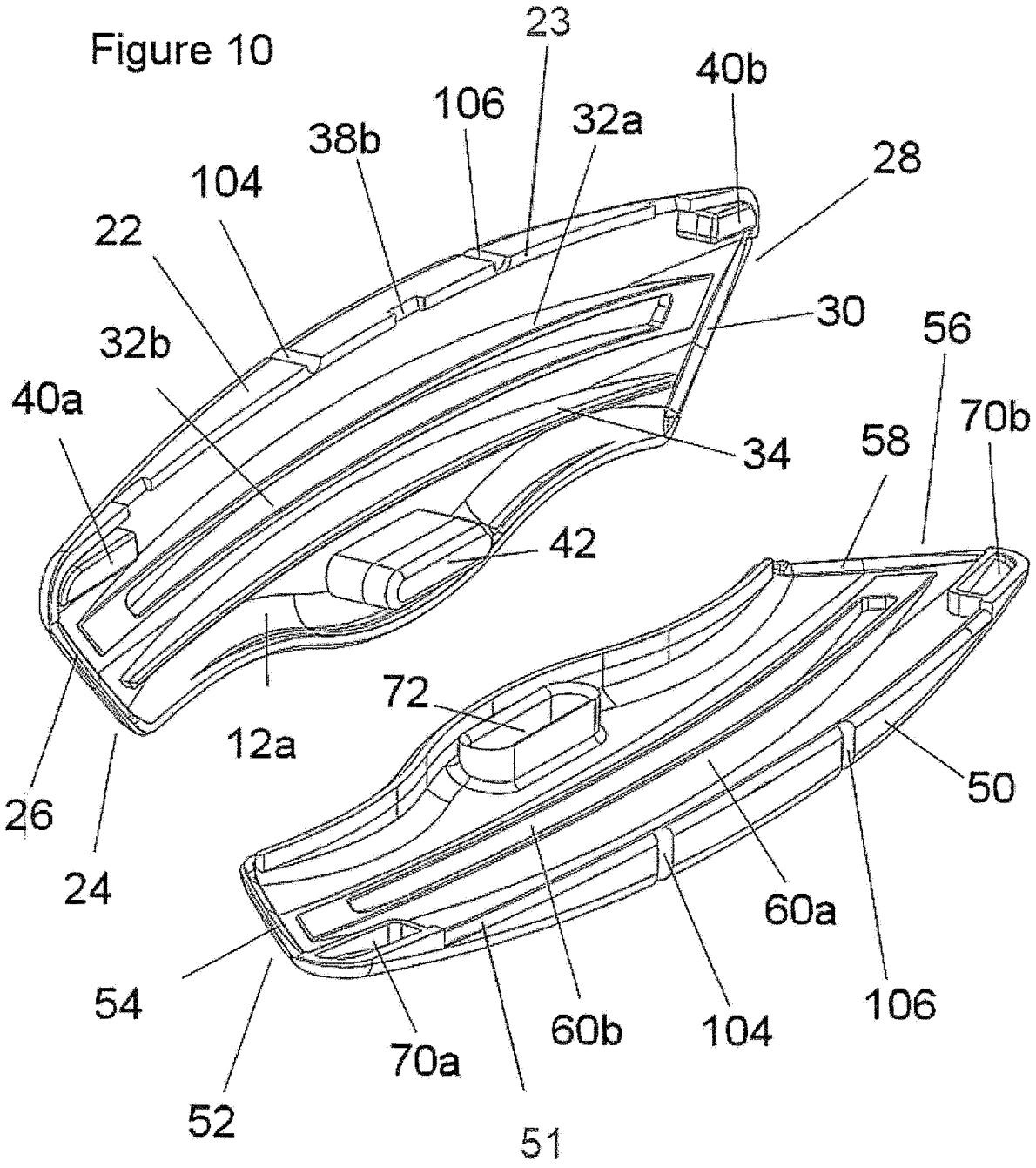
FIG. 10 is an assembly view of the knife of FIG. 1, showing the handle halves in a separated orientation to reveal internal structural details, according to the invention.

As shown in the sectional view of FIG. 8, shuttle 14 is adapted to snugly slide within handle cavity 20 along shuttle guide rails 32*a* and 32*b* of handle half 12*a* and shuttle guide rails 60*a* and 60*b* of handle 12*b*, A shuffle gap 110 is created between shuttle guide rails 32*a*, 32*b* of handle half 12*a* and shuttle guide rails 60*a* and 60*b* of handle 12*b*, within which shuffle 14 resides and slides. Shuttle guide mils 32*a,b*, 60*a,b* guide shuttle 14 along the arcuate path defined by the shape of the guide rails as the shuttle moves between first end 24 and second end 28 of handle 12. As shown in FIGS. 6, 8 and 10, handle 12*a* includes blade guide rail 34 which is meant to support blade 16 and prevent shuttle 14 and blade 16 from rotating. When tab 94 is pushed laterally against the natural spring bias of stem 90 to release the stem from one of the locking notches 38*a-c*, the lateral push force may cause shuttle 14 to rotate within handle 12 a small degree, thereby forcing blade 16 in the opposite direction, against blade guide rail 34. Blade guide rail 34 prevents blade 16 from rotating, Since tab 94 will only be pushed in one lateral direction, a blade guide rail 34 is only required on handle half 12*a*, as shown in the figures.

In assembly, shuttle 14 with blade 16 secured therein, is positioned within handle half 12*a* so that curved tab 94 is bent toward locking notches 38*a-c*, and so that left side guide channel 84*a* of shuttle body 80 is mounted to shuttle guide rails 32*a* and 32*b*. Handle half 12*b* is then positioned against handle half 12*a* so that lower central protrusion 42 of handle half 12*a* enters lower central recess 72 of handle half 12*b*, and upper protrusions 40*a*, 40*b* of handle half 12*a* enter upper recesses 70*a*, 70*b* of handle half 12*b*, respectfully. The two handle halves 12*a* and 12*b* are then securely bonded to each other, preferably using an ultrasonic welding process so that the two plastic handle halves literally weld to each other at all points of contact. When the handle halves are secured to each other, forming a single handle unit 12, shuttle 14 and blade 16 can be moved between first end 24 and second end 28. The final step is to position flip lock 18 over the top of handle 12 so that crossbar 98 resides across upper surfaces 22, 50 and so that central bores 102 of each bearing boss 100 resides over each post 44, 74 of handle 12.

In operation, a user holds knife 10, according to the present invention, in one hand. As a starting point in explaining the operation of knife 10, reference is made to FIG. 1, wherein shuttle 14 (not visible in FIG. 1 because it is located within cavity 20 of handle 12) and blade 16 are located at second end 28 of handle 12 so that blade 16 extends past handle 12 exposing a first cutting edge portion 110 for useful work. In this position, stem 90 is engaged with locking notch 38*c* by the stem's spring-bias. Therefore, when stem 90 of shuttle 14 is engaged in any locking notch 38*a*, 38*b*, or 38*c*, shuttle 14 and blade 16 are locked in that position. When blade 16 is locked, as described, it will not retract back into handle 12 when the blade is being used to cut material, that is until stem 90 is disengaged from locking notch 38*c* and shuttle 14 pulled back into handle 12 by the user's thumb.

According to the invention, when the user if done cutting for the moment, he or she may disengage stem 90 from locking notch 38*c* by using his or her thumb to move tab 94 against the spring-bias of stem 90 until the stem is disengaged from locking notch 38*c*, at which point, the user may use his or her thumb to slide tab 94 within slot 95 to a center position, wherein stem 90 automatically engages with locking notch 38*b*, as shown in FIG. 2, due to the spring-bias resiliency of stem 90.

A concern with a knife wherein a blade can move from one end of a handle to another end of the handle is that the sharp blade may accidentally move to the opposite end of the handle and cut a user's hand. To prevent this from happening, according to an important feature of at least one embodiment of the invention, knife 10 includes flip lock 18. Tab 94 cannot be accidentally moved to the opposite first end 24 of handle 12 because tab 94 is blocked from advancing past flip lock 18, since crossbar 98 of the flip lock is located between the centrally located locking notch 38*b* and locking notch 38*a*, and also crosses over slot 95. Flip lock 18 effectively retains shuttle 14 and blade 16 safety on one expected side of handle 12.

The user may release shuttle 14 from the central locked position of FIG. 2 and again advance, the shuttle and blade 16 forward towards second end 28 of handle 12 until stem 90 again engages with locking notch 38*c* and blade 16 again protrudes from handle 12, as shown in FIG. 1.

Eventually, first cutting edge portion 110 of blade 16 will dull. At this point, according to the invention, the user may relocate shuttle 14 to the opposite first end 24 of handle 12 to allow usage of a second cutting edge portion 112 of blade 16. To do this, the user again moves shuttle 14 and blade 16 back to the central locked position, as shown in FIG. 2. In this position, flip lock 18 may be pivoted from first locked position (closer to the handle end labeled "ONE"), shown in FIG. 1, to a vertical unlocked position, as shown in FIG. 3 and indicated by arrow 19, and then finally to a second locked position (located closer to the handle end labeled "TWO"), as shown in FIG. 4. In moving flip lock 18 from the first locked position to the second locked position, crossbar 98 will have moved to the other side of tab 94. This new position now allows the user to advance tab 94 towards the opposite first end 24, indicated by arrow 114 (towards the handle end labeled "ONE"). When shuttle 14 is moved all the way to first end 24 of handle 12, as shown in FIG. 5, to locked notch 38*a*, blade 16 again protrudes from handle 12, but now revealing second cutting edge portion 112 of blade 16, which is sharp. The user may now enjoy more cutting time using the newly revealed sharp cutting edge, as shown in FIG. 5.

According to the invention, the use of flip lock 18 provides an intuitive and readily understandable means to prevent accidental injury to the user of knife 10. In using flip lock 18, the user must be aware as he or she flips crossbar 98 over tab 94 and therefore will be aware of the new direction of movement of shuttle 14 and blade 16. Knife 10 is easy to understand, easy to use, and safe, and it provides twice the cutting life as conventional disposable utility knives.

Although tab 94 and stem 90 is used in combination with locking notches 38*a*-38*c*, as described above, in accordance with the present invention, locking notches are not required to carry out the present invention, just preferred. In such instance, stem 90 can be formed straight and can easily, slide along slot 95 without locking. Flip lock 18 would still prevent shuttle 14 and blade 16 from traversing to the opposite end of handle 12. In use, with this arrangement, the user will have to retain a thumb (or finger) on tab 94 to continually force blade 16 in an extended condition during a cutting operation.

It is also contemplated that other types of locking techniques may be used in place of the laterally spring-biased stem 90 and locking notches 38*a*-38*c*. This includes a well known push to release type locking action wherein a tab is spring-biased up and will automatically lock into looking notches, similar to the locking notches 38*a*-38*c*. With this arrangement, the tab is depressed downward to release the shuttle from any of the locking notches. Other locking mechanisms can be used as well.

Applicant has recognized that when shuttle 14 of the present invention is positioned at either end 24, 28 of handle 12 and a user pulls tab 94 back using his or her thumb to retract blade 16 into handle 12, shuttle 14 may torque a bit owing to the moment arm provided by the tab and stem length. This torque may cause shuttle 14 to rotate a bit and therefore bind between guide channels 84*a*, 84*b* and respective guide rails 32, 60. The result is that the shuttle will not move smoothly along guide rails 32, 60 until shuttle moves away from the handle end. To overcome this potential issue, the present invention provides specific handle structure to support shuttle 14 at the end locations 24, 28 so that it does not rotate when tab 94 is pulled by the user's thumb. The support structure is shown in FIG. 12, wherein a support wall 120 is positioned to snugly contact a portion of upper surface 122 of shuttle 14 when shuttle 14 is advanced fully to either end 24, 28 of handle 12. When a user pulls back on tab 94, shuttle cannot rotate because the rotational force generated by the user's pulling force is cancelled by an equal and opposite force generated by upper surface 122 of shuttle 14 contacting support wall 120. The end result is that shuttle 14 remains aligned with guide rails 32, 60 and shuttle moves smoothly along the entire length of the guide rails.

Figure 13:
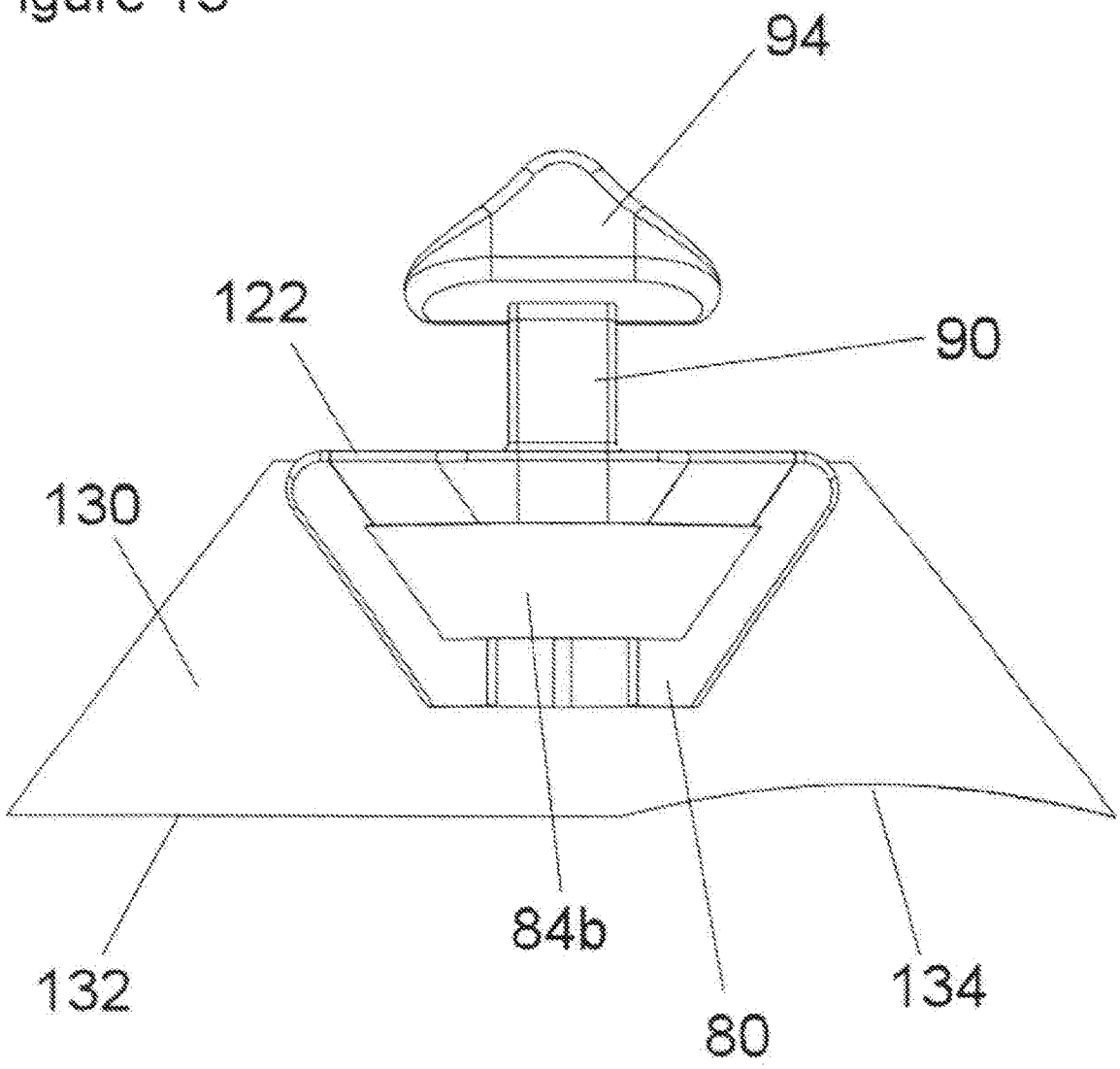
FIG. 13 is a side view of the shuttle and blade, according to another embodiment of the present invention.

According to another feature the invention, shown in FIG. 13, a blade 130 is formed to include two different shaped cutting edges, a first cutting edge 132 which is shown straight, and an opposing second cutting edge 134 is shown curved. This manner, knife 10 can offer two different types of cutting, instead of just providing the user with another sharp cutting edge. Also, one side of blade 130 can be formed with a shorter cutting edge than the other so that when one side of the blade is used, it will cut less deep into the material. This may be useful for cutting boxes. If a deeper cut is required, the user may simple slide the shuttle and blade to the opposite side of the knife handle, as described above.

Safety Label

The present utility knife 10 is inexpensive to manufacture and is meant to provide a user a low cost disposable utility knife. To help keep the costs low, yet provide safety measures at the point of purchase (e.g., in a store), the knife packaging can include features that provide safety to the customer, while allowing the customer a controlled amount of operational access to the knife, without removing the knife from any packaging.

Figure 14A:
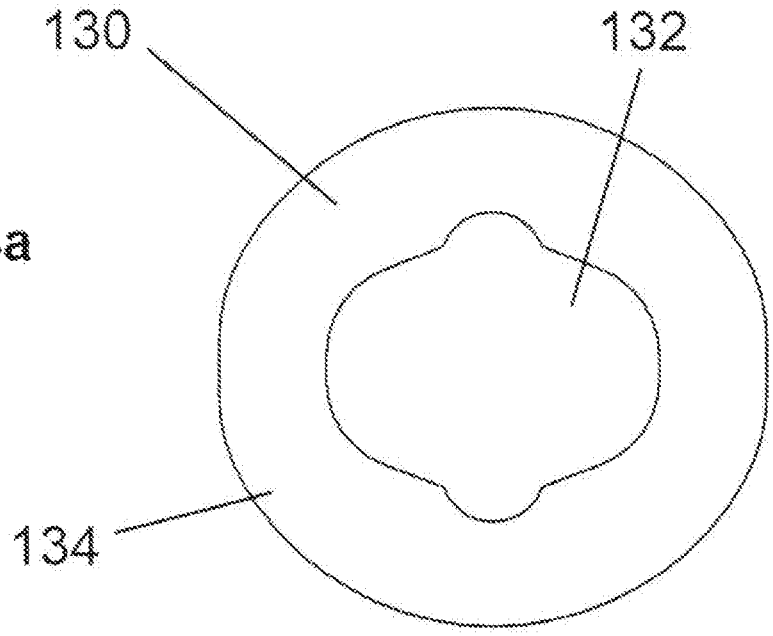
FIG. 14*a* is a plan view of a safety label having an exemplary shape, according to another embodiment of the invention.
Figure 14B:
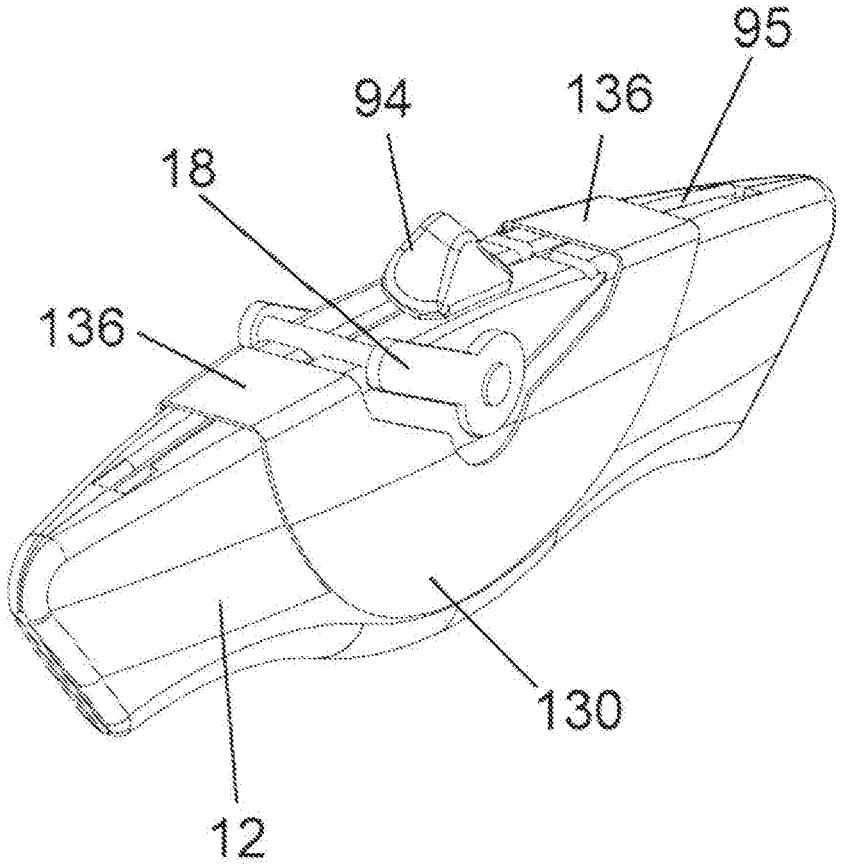
FIG. 14*b* is a perspective view of the knife of the present invention showing the safety label of FIG. 14*a* secured thereto, and providing the knife with security, according to this embodiment of the invention.

Referring now to FIGS. 9, 14*a*, and 14*b*, a safety label 130 is shown, according to another aspect of the present invention. As shown in FIG. 14*a*, a plan view of a label 130 is shown having an exemplary shape to help explain its inventive features, according to the present invention. Label 130 is sized and shaped to be secured to handle 12 of knife 10, as shown in the FIG. 14*b*. In this example, label 130 is meant to be centered on top surface 50 of knife 10 and folded down against each outside surface of handle halve 12*a*, 12*b*, symmetrically. As shown in FIG. 14*a*, label 130 is, in this example, generally circular in shape, includes a central opening 132 and defines an upper printable surface 134 and an opposing adhesive surface (not shown). Label 130 is preferably applied to handle 12, once assembled at a point of manufacture. Label 130 bonds to handle 12 by the adhesive, which is selected depending on the material chosen for handle 12 the material chosen for the label 130 and whether or not the label is to be removed by peeling (see below). An important feature of label 130 is that it is made from a strong tear-resistant material, such as a fiber-reinforced material. One such suitable material is called Tyvek®, made by DuPont™ of Wilmington, Del. Tyvek® is a unique nonwoven material made of 100% high density polyethylene fibers randomly laid and compressed to form a tough, tear-resistant and printable substrate. Tyvek® can be provided with an application-based adhesive on one surface and be printed with product marketing and use information on printable surface 134.

As shown in FIG. 14*b*, label 130 is securely affixed to handle 12 of knife 10 so that tab 94 and flip lock 18 is positioned within central opening 132. Central opening 132 is preferably sized and shaped to allow a predetermined and controlled amount of sliding displacement of tab 94 within slot 95 before tab 94 contacts a portion of label 130 and is blocked from further movement by sections 136 of label 130 which cover slot 95, as shown in FIG. 14*b*. Also, flip lock 18 may be pivoted between its full range of movement by a customer. Central opening 132 of label 130 is sized and shaped to only allow some sliding movement of tab 94, and is small enough to stop the sliding movement of tab 94 before blade 16 (not shown in FIGS. 14*a*, 14*b*) extends beyond either end of handle 12. In other words, label 130 provides a customer limited "testing" movement of tab 94 and flip lock 18, when deciding to purchase knife 10, while preventing the customer from moving tab 94 sufficiently to extend blade 16 beyond either end of handle 12. Blade 16, and therefore cutting edges 110, 112 remain safely within handle 12 while knife 10 is being "tested" by a customer in a store. Safety label 130, according to this invention allows a customer to safely handle knife 10 in a store, learn its features without exposing any sharp edges, and while requiring a minimal amount of low-cost packaging (a label). Knife 10, with the use of safety label 130 is therefore suitable for so-called "dump bin" marketing wherein low-cost minimally packaged products in a store may be provided to a customer in a large bin from which one product may be selectively removed by the customer for purchase.

Once a customer purchases knife 10 and prior to use, the customer (user) must cut or peel off label 130 so that tab 94 is allowed free sliding movement along slot 95 of knife 10. Once tab may slide the full extents, of slot 95, blade 16 may selectively extend beyond handle 12, exposing cutting edges 110, 112 for useful cutting work by the user. In the case that label 130 is meant to be peeled from handle 12, the adhesive used to secure label 130 to the handle must be selected to provide such peeling with a predetermined degree of difficulty. If label 130 is meant to be cut (along slot 95), the adhesive used may be much stronger since most of the label is meant to remain secured to handle 12.

Although the safety label 130 shown in FIGS. 14*a*, 14*b* is generally circular in perimeter shape with a generally circular central cutout, the shape and size of label 130 may vary according to the specific handle shape and operational details of knife 10. The specific shape and size of knife 10 and all the components, and label 130 is meant to be exemplary to help explain the present invention. As is understood by those of general skill in the art, other shaped knife components, including handle halves 12*a*, 12*b*, blade 16, shuttle 14, flip-lock 18, tab 94, and label 130 may be used without departing from the spirit and scope of the present invention.

An additional aspect of the present invention allows for a process of using a utility knife comprising the steps of providing a portable utility knife comprising: a hollow elongated handle sized and shaped to be easily gripped by a user's, hand, said handle including an upper surface and opposing first and second ends, said hollow handle defining a cavity therein; an elongated slot disposed along said upper surface, said slot providing access through said handle to said cavity; a first opening located at said first end and a second opening located at said second end, said first and second openings extending through said handle to said cavity; a blade shuttle positioned within said cavity and selectively slidable between said first end and said second end; a razor blade secured to said shuttle, said razor blade having a cutting, edge, said cutting edge defining a first cutting edge section and a second cutting edge section so that when said shuttle is positioned within said cavity and adjacent said first end, said first cutting edge section of said razor blade extends through said first opening of said handle to expose said first cutting edge section to provide useful cutting work, and when said shuttle is positioned adjacent said second end, said second cutting edge section of said razor blade extends through said second opening to expose said second cutting edge section to provide useful cutting work; a tab attached to said blade shuttle, said tab extending through said elongated slot so that a portion of said tab is accessible to a user, said tab may be used to slide said shuttle within said cavity between said first and second ends; and a movable locking component attached to said handle, said locking component being selectively moveable between a first position, wherein said tab is prevented from sliding within said elongated slot, and a second position, wherein said tab is permitted to slid within said elongated slot.

Sliding the blade to one of a first end position or a second end position; locking the blade within one of a plurality of locking positions; and, moving a locking lever to allow the blade to retract from one end of the knife and to extend from a second end of the knife.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

What is claimed is:

1. A portable utility knife comprising:

a hollow elongated handle including opposing first and second ends, and defining a slot surface therebetween, said hollow handle defining a cavity therein and having a midpoint located equidistant from said first end and said second end;

an elongated slot within said slot surface, said elongated slot providing access through said handle to said cavity;

a first opening located at said first end and a second opening located at said second end, said first and second openings extending through said handle to said cavity;

a blade shuttle positioned within said cavity and selectively slidable between said first end and said second end;

a razor blade secured to said shuttle, so that when said shuttle is adjacent said first end, said razor blade extends through said first opening of said handle, and when said shuttle is positioned adjacent said second end, said razor blade extends through said second opening;

a tab attached to said blade shuttle, said tab extending through said elongated slot so that a portion of said tab is accessible to a user, said tab being used to selectively slide said shuttle within said cavity between said first and second ends; and a movable blocking component attached to said handle substantially at said midpoint, said blocking component being selectively moveable between a first position, wherein said tab is blocked from sliding past blocking component and a second position, wherein said tab is permitted to slide past said blocking component.

2. The knife according to claim 1, wherein said blocking component is U-shaped and is pivotally attached to said handle.

3. The knife according to claim 2, wherein said U-shaped blocking component is pivotally attached to said handle across said elongated slot and is pivotal between the first position and the second position.

4. The knife according to claim 1, wherein said elongated slot includes at least one locking notch into which said tab selectively engages to lock said tab with respect to said handle.

5. The knife according to claim 4, wherein said tab is spring-biased to automatically engage said at least one locking notch when said tab aligns with said at least one locking notch during sliding displacement along said elongated slot.

6. The knife according to claim 4, wherein said at least one locking notch is positioned at said midpoint.

7. The knife according to claim 1, wherein said locking component is located at said midpoint.

8. A safety knife for use by a user, said knife comprising:

an elongated handle having opposing first and second ends;

a blade assembly slidably attached to said handle, said blade assembly being selectively slidable between said first and second ends, said blade assembly including a cutting edge that is exposed when said blade assembly is located adjacent one of said first and second ends;

a tab projecting from said elongated handle and being connected to said blade assembly so that sliding movement of said tab causes sliding movement of said blade assembly, said tab being slidable along a path; and an obstructive component moveably attached to said handle, adjacent said path, said obstructive component being moveable between an obstructive position, wherein said obstructive component becomes positioned directly across said path of said tab, thereby preventing said tab from sliding along said path, past said obstructive component and a non obstructive position, wherein sliding passage of said tab past said obstructive component is permitted.

9. The knife according to claim 8, wherein said elongated handle is hollow and said blade assembly is slidably disposed within said hollow handle.

10. The knife according to claim 8, wherein said obstructive component is a U-shaped member that is pivotally attached to said handle.

11. The knife according to claim 10, wherein said U-shaped Obstructive component is pivotally attached to said handle across an elongated slot formed in said handle and is pivotal between said obstructive position and said non-obstructive position.

12. The knife according to claim 11, wherein said elongated slot includes at least one locking notch into which said tab selectively engages to lock said tab with respect to said handle.

13. The knife according to claim 12, wherein said tab is spring-biased to automatically engage said at least one locking notch when said tab aligns with said at least one locking notch during sliding displacement along said elongated slot.

14. The knife according to claim 12, wherein said at least one locking notch is positioned at a midpoint of said elongated slot.

15. The knife according to claim 12, wherein said obstructive component is attached at a midpoint of the handle.

16. A safety knife for use by a user, said knife comprising:

an elongated handle having opposing first and second ends;

a blade assembly slidably attached to said handle, said blade assembly being selectively slidable between said first and second ends, said blade assembly including a cutting edge that is exposed when said blade assembly is located adjacent one of said first and second ends;

an access tab attached to said blade assembly and slidable along a path; and a U-shaped blocking component pivotally attached to said handle between a blocking position, wherein said path is blocked and said access tab is physically prevented from sliding along said path past said blocking component and thereby preventing said blade assembly from reaching one of said first and second ends, and a non-blocking position, wherein said tab is permitted to slide past said blocking component.

17. The knife according to claim 16, wherein said handle includes at least one locking notch into which said tab may selectively engage to lock said tab with respect to said handle.

18. The knife according to claim 17, wherein said tab is spring-biased to automatically engage said at least one locking notch when said tab aligns with said at least one locking notch during sliding movement between said first and second ends.

19. The knife according to claim 17, wherein said at least one locking notch is positioned generally at a midpoint between said first and second ends.

* * * * *